US008264171B1

(12) United States Patent
Domer

(10) Patent No.: US 8,264,171 B1
(45) Date of Patent: Sep. 11, 2012

(54) IN-SITU LED JUNCTION TEMPERATURE MONITORING USING LED AS TEMPERATURE SENSOR

(75) Inventor: Steven M. Domer, Mesa, AZ (US)

(73) Assignee: IXYS Corporation, Milpitas, CA (US)

( * ) Notice: Subject to any disclaimer, the term of this patent is extended or adjusted under 35 U.S.C. 154(b) by 321 days.

(21) Appl. No.: 12/775,877

(22) Filed: May 7, 2010

Related U.S. Application Data

(60) Provisional application No. 61/180,771, filed on May 22, 2009.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/309; 315/32; 315/291; 315/307

(58) Field of Classification Search ..... None
See application file for complete search history.

(56) References Cited

U.S. PATENT DOCUMENTS

2010/0315019 A1* 12/2010 Hoogzaad et al. ..... 315/291
2011/0031903 A1* 2/2011 Nguyen Hoang et al. .... 315/309

* cited by examiner

*Primary Examiner* — Anh Tran
(74) *Attorney, Agent, or Firm* — Kilpatrick Townsend & Stockton LLP

(57) ABSTRACT

LED junction temperature is determined in real time using the LED itself as the temperature sensor for directly measuring the LED junction temperature. In addition, temperature measurements from a silicon diode placed in proximity to the LED are also used to complement the temperature measurements from the LED itself. Arbitration is performed among temperature measurements from the LED and temperature measurements from the silicon diode to determine a temperature of the LED junction. The determined LED junction temperature may be used to make adjustments to the LED drive current. Temperature measurements from the LED are made in real time during actual operation by applying snooping currents to the LED during off-times of the PWM cycles of the LED, without interrupting normal operation of the LED.

22 Claims, 6 Drawing Sheets

IN-SITU LED JUNCTION TEMPERATURE MONITORING USING LED AS TEMPERATURE SENSOR

CROSS-REFERENCES TO RELATED APPLICATIONS

The present application claims priority to U.S. Provisional Application No. 61/180,771, filed May 22, 2009, and is incorporated herein by reference in its entirety for all purposes.

BACKGROUND OF THE INVENTION

The present invention relates to monitoring the temperature of the LED junction in situ and adjusting the current driving the LED according to the determined temperature of the LED.

In various LED lighting applications, determining and maintaining LED junction temperatures during operation is necessary for ensuring reliability and performance of the LED lighting applications. Typically, in order to monitor LED temperature, dedicated temperature sensing diodes or thermistors are placed as physically close to the LED lamp as design constraints permit but external to the LED. For example, discrete precision silicon temperature diodes or thermistors (negative temperature coefficient resistors) are placed in proximity, external to the LEDs, and used to "estimate" the temperature of the LED junctions. However, such external temperature sensors can only measure the ambient temperature of the LEDs and cannot measure the temperature of the internal junction of the LEDs themselves. In LED applications, the conventional approach is to position the external temperature sensors as close to the solder or thermal pad point of an LED as possible, so that the measured temperature is the LED's local ambient temperature, circuit board temperature, or external solder point temperature. However, the measured temperature is still not the actual LED PN junction temperature. Thus, these conventional approaches are not capable of sensing the actual LED PN junction temperature, because they are external to the LED. Especially, at higher operating currents, the actual LED junction temperature may be significantly different from the ambient temperature, and thus conventional LED temperature sensing techniques can be largely inaccurate. In other words, these external temperature sensors have the disadvantage that they cannot measure the critical junction temperature of the LED itself. This limits the ability to accurately monitor the real time self-heating effects of the LED.

Furthermore, conventional LED applications typically use pre-characterized thermal information to "pad" the measured temperature of the external point sensed by the external temperature sensor to account for "estimated" variations at the LED junction. This "padding" scheme has the disadvantage that system cost may increase as much as 20% as more LED lamps are required in these "padded" designs to meet the needed illumination specifications.

One approach, known as the CTAT (Complementary To Absolute Temperature) technique, uses the LED itself as the temperature sensing device with the specific LEDs pre-characterized and calibrated extensively under controlled conditions to determine the "K" factor (i.e. the change in LED forward voltage, $V_F$, over temperature, at a constant forward bias current, $I_F$). The CTAT approach is based on the principle that the LED forward voltage, $V_F$, has a decreasing rate with increasing temperature. However, the CTAT technique requires both a known starting temperature point and the pre-characterized CTAT temperature coefficient (i.e. "K" factor) a priori in order to calculate a new temperature point. Thus, CTAT itself is not a solution for in situ sensing of LED junction temperature, since it is not possible to control the starting temperature point of LED applications in actual use.

Another method of temperature measurement for diodes is called the PTAT (Proportional To Absolute Temperature) technique, which resolves the issue of determining the starting temperature. The PTAT method is the basis for band-gap regulator circuits, and takes advantage of the fact that the difference in the forward voltages ($V_{F2}-V_{F1}$) across a PN junction of a diode taken at two different forward currents, $I_{F2}$ and $I_{F1}$, is directly proportional to the absolute temperature. The PTAT approach works well for silicon based temperature diodes with near ideal characteristics. However, as LEDs do vary considerably from the ideal diode properties, use of the PTAT approach to sense the temperature of LEDs require extensive up-front calibration, which makes the use of the PTAT approach itself impractical for LED temperature sensing during "real time" operation.

BRIEF SUMMARY OF THE INVENTION

Embodiments of the present invention include a method for determining the LED junction temperature in "real time" using the LED itself as the temperature sensor for directly measuring the critical LED junction temperature. In addition, temperature measurements from a silicon diode placed in proximity to the LED are also used to complement the temperature measurements from the LED itself. In one embodiment, arbitration is performed among temperature measurements from the LED using both the PTAT method and the CTAT method and temperature measurements from the silicon diode using both the PTAT method and the CTAT method to determine the arbitrated temperature of the LED junction. The determined temperature of the LED junction may be used to make adjustments to the LED drive current for driving the LED.

Temperature measurements from the LED using the PTAT and CTAT methods are made by applying "snooping currents" to the LED during off-times of the PWM cycles driving the LED 114, without interrupting the normal operation of the LED. Thus, the LED junction temperature can be measured directly in real time (in situ) during actual system operation, as well as during a power-on calibration phase. Also, the present invention has the advantage that LED temperature measurement can be made with enhanced accuracy and reliability but with lower component count and cost, since the LED itself is used as the temperature sensor.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF THE INVENTION

Figure 1:
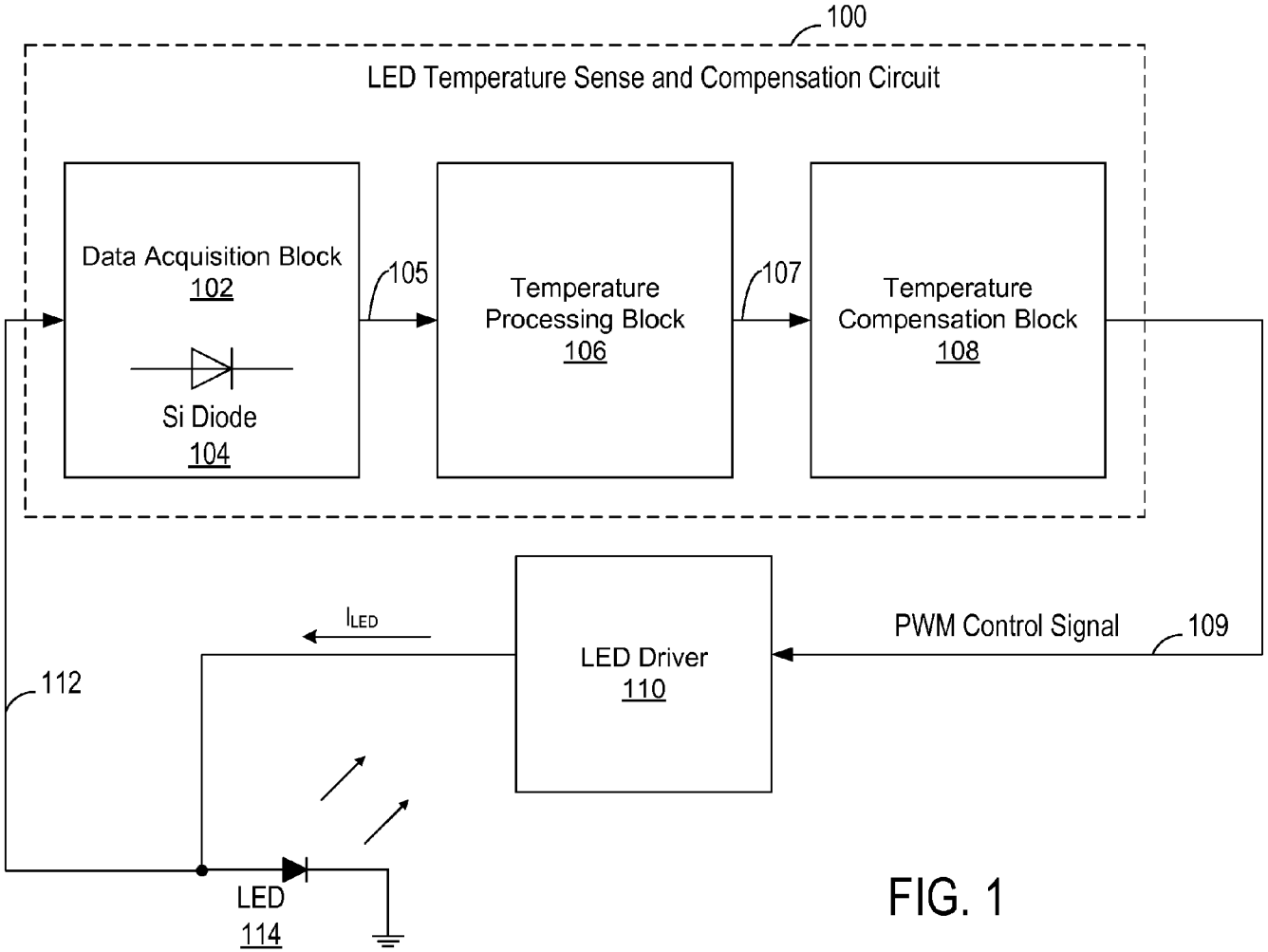
FIG. 1 is a block diagram illustrating the functional circuit blocks of an LED temperature sense and compensation circuit according to one embodiment.

The figures and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

LEDs generally behave physically and electrically as PN diodes. However LEDs have several non-ideal diode characteristics which make it difficult for their use as temperature monitoring and sensing devices. The temperature of silicon PN diodes has routinely been measured by application of the standard "diode equation" also known as the "Shockley Diode Equation." However, since LEDs are based on compound semiconductors, other than silicon, LEDs exhibit more complex properties and have non-ideal PN diode characteristics. As a result, the direct use of an LED itself as the "real time" temperature sensing device for in situ operation presents several technical difficulties.

A derivative form of the "diode equation" can be presented to give the forward voltage ($V_F$) behavior of a PN semiconductor diode with respect to temperature. At any given current, the forward voltage ($V_F$) of a PN junction diode is given by Equation 1.

$$V_F = \frac{\eta(kT)}{q} x \ln\left(\frac{I_F}{I_S}\right), \qquad \text{Equation 1}$$

where $\eta$ is the ideality factor (approximately 1 for silicon), k is the Boltzmann constant ($=1.38\times10^{-23}$ Joules/° K), q is the charge of an electron ($=1.602\times10^{-19}$ coulombs), T is the Absolute Temperature in ° K, $I_F$ is the diode forward current in Ampere (A), and $I_S$ is the diode reverse saturation current in Ampere (A). LEDs, however, are based on compound semiconductors other than silicon structures and have more complex dependency between forward voltage and current according to the following Equation 2:

$$V_{F_LED} = \frac{E_g}{q} + \frac{\eta kT}{q} \ln\left(\frac{I_F}{I_S}\right) + R_S I_F, \qquad \text{Equation 2}$$

where $R_s$ is the LED series resistance in Ω, $E_g$ is the bandgap energy of the material that determines the wavelength of the emitted light, and $$E_g = \frac{hc}{\lambda}, \qquad \text{Equation 3}$$

where h is Planck's constant ($h=6.626\times10^{-34}$ Joules·s), c is the speed of light ($c=3.0\times10^{8}$ m/s) and $\lambda$ is the wavelength of the emitted light in meters.

For LEDs, the ideality factor $\eta$ in the diode equation, representing the non-ideality of the PN diode due to defects and other recombination leakages, typically exceeds 1 and has been reported as high as approximately 4. The ideality factor $\eta$ varies significantly based upon the material and process used to manufacture the LEDs. Such variation of the ideality factor $\eta$ and the dependence of the LED forward voltage $V_F$ on its series resistance, $R_s$, at high LED operating currents are major contributors of the non-ideal LED diode behavior. As a result, the direct use of the LED itself as a "real time" temperature sensing device for in situ operation presents difficulties.

As explained above, the CTAT method measures the forward voltage, $V_F$, across the PN diode at two different temperatures $T_1$ and $T_2$ at a constant forward current bias, $I_F$. Given these conditions, the change in the forward voltage $V_F$ is basically linear and decreases with increases in the temperature difference (i.e., the change in the forward voltage is complementary to temperature). For silicon diodes, the forward voltage typically changes at a rate of about −2 mV/° K (for every degree Kelvin increase in the temperature difference, the $V_F$ decreases by about 2 mV); this rate is referred to as the CTAT temperature coefficient (also referenced below as the LED CTAT "K" factor). However, the CTAT temperature coefficient may be dependent upon the forward current and process variations. The CTAT approach therefore requires some pre-characterized or a priori information of the CTAT temperature coefficient. This is typically supplied by temperature diode manufacturers. Temperature changes can then be determined using the pre-characterized coefficient and a known starting temperature point. Accordingly, the CTAT technique has limits in "real time" operation, as there could be varying starting temperature points which are not known ahead of time.

As for the PTAT technique, this method for making temperature measurements does not require determining the starting point temperature, and forms the basis for band-gap regulator circuits. The PTAT technique relies on the principle that the difference in forward voltages ($\Delta V_F = V_{F2} - V_H$) across a PN junction of a diode taken at two different forward currents, $I_{F2}$ and $I_{F1}$, respectively, are related per Equation 4:

$$\Delta V_F = \frac{\eta kT}{q} \ln\left(\frac{I_{F2}}{I_{F1}}\right) + R_S(I_{F2} - I_{F1}). \qquad \text{Equation 4}$$

The difference in forward voltages, $\Delta V_F$, is directly proportional to the absolute temperature (T). For a given diode, at a given $I_{F2}/I_{F1}$ ratio, the temperature point is an absolute value and the rate of change of the difference in forward voltages ($\Delta V_F = V_{F2} - V_{F1}$) is positive with increasing temperature. The PTAT approach works well for silicon based temperature diodes whose characteristics are very close to ideal (i.e., when $\eta$ is approximately 1 and the $R_S \times (I_{F2} - I_{F1})$ term in Equation 4 is insignificant). However, since LEDs do vary considerably from ideal diode properties, use of the PTAT approach with LEDs has not been practical.

In contrast to the conventional methods, according to embodiments of the present invention, the temperature of a measured LED can be measured by a control circuit that applies low level "snooping" currents to extract "real time" I-V (current vs. voltage) data points of the measured LED, and to extract similar data from a silicon diode placed in close proximity of the measured LED. These I-V measurements can be processed digitally to calculate the junction temperature of the target LED and of the silicon diode, for example, by CTAT and PTAT methods. Arbitration of the temperature measurements from the LED and the silicon diode can be performed to determine an arbitrated temperature of the measured LED, which can then be used to control an LED operating current, for example via PWM (pulse width modulation), to adjust the LED operating current ($I_{LED}$) according to the determined temperature of the measured LED.

Turning to the figures, FIG. 1 is a block diagram illustrating the functional circuit blocks of an LED temperature sense and compensation circuit according to an embodiment. An LED temperature sense and compensation circuit 100 may include a data acquisition block 102, a temperature processing block 106, and a temperature compensation block 108. Data acquisition block 102 may include a silicon temperature diode (Si-diode) 104 that is placed in proximity to an LED 114.

Data acquisition block 102 can obtain current-forward voltage (I-V) measurements from both the LED 114 (via signal line 112) and the Si-diode 104 to provide such I-V measurements 105 to the temperature processing block 106. Data acquisition block 102 may include at least one set of I-V measurements from the LED 114 itself and at least one set of I-V measurements from the Si-diode 104. For example, data acquisition block 102 may obtain 4 sets of I-V measurements: one set of I-V measurements for determining a PTAT measured temperature of the LED 114; another set of I-V measurements for determining a CTAT measured temperature of the LED; still another set of I-V measurements for determining a PTAT measured temperature of the Si-diode 104; and still another set of I-V measurements for determining a CTAT measured temperature of the Si-diode. These four data samples may be measured every 2-3 seconds (for example), during a very small fraction of the PWM cycles that drive the LED 114, as will be explained in more detail below with reference to FIG. 3. Typically, these I-V measurements are analog measurements. The data acquisition block 102 may include analog-to-digital conversion circuitry to convert the analog I-V measurements into digital information for further processing.

In an embodiment, the temperature processing block 106 may receive the I-V measurements 105 (for example, in the form of digital information) and generate a temperature value 107 corresponding to a determined temperature of the LED 114 in operation. Temperature compensation block 108 may generate a PWM control signal 109 according to the determined temperature value 107 of the LED 114 to compensate for any temperature changes. For example, temperature compensation block 108 may include user-loaded LUTs (look up tables) that store PWM duty cycle corrections codes across the desired temperature range. The LUTs can then be indexed using the determined temperature 107 of the LED 114 to determine a temperature-compensated duty cycle of the PWM control signal 109. LED driver 110 can then drive current through LED 114 according to the temperature-compensated PWM control signal 109. Each of the functional circuit blocks of the LED temperature sense and compensation circuit 100 is explained in further detail below.

Figure 2:
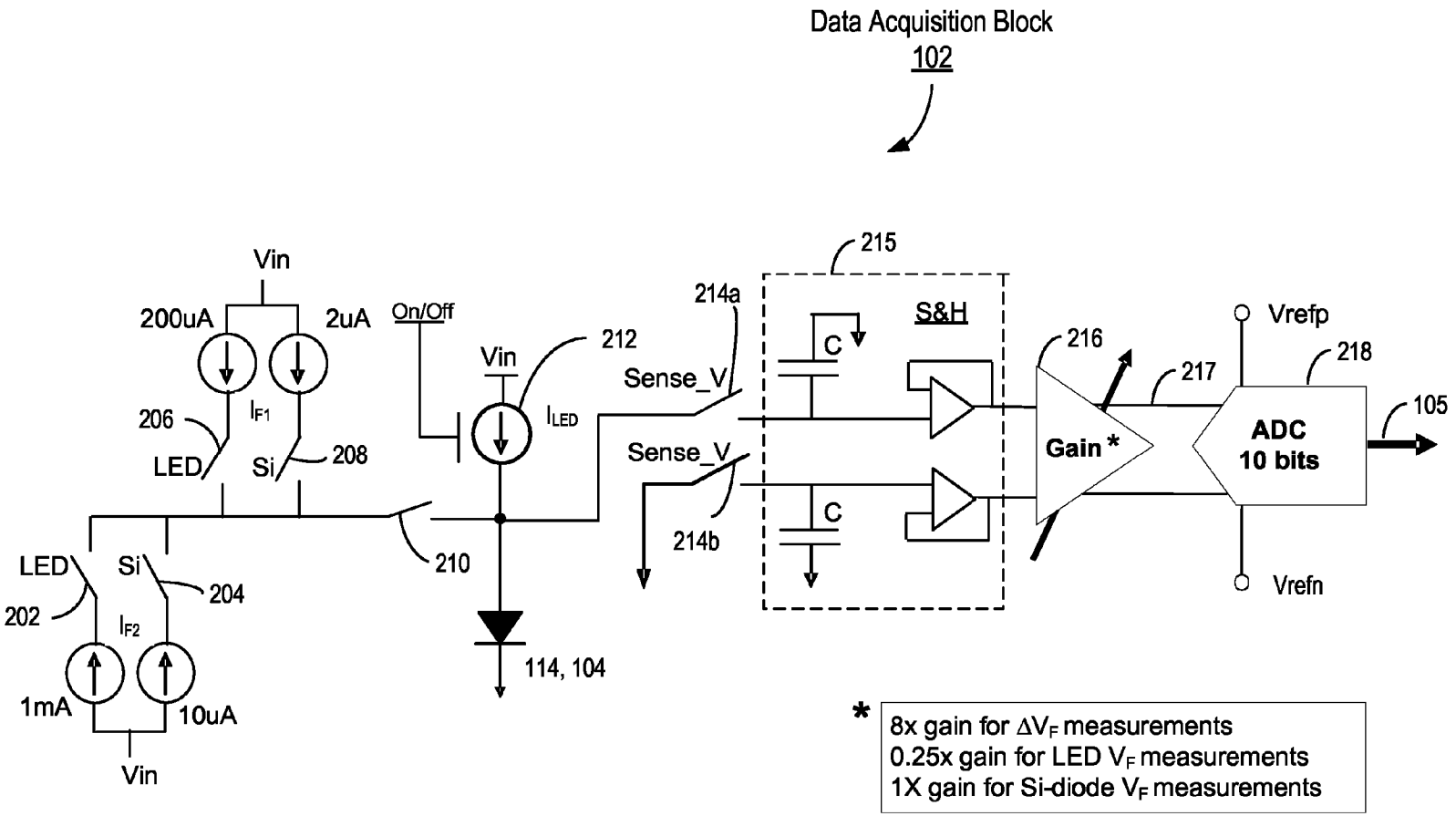
FIG. 2 illustrates the data acquisition circuit block 102 in more detail, according to one embodiment.

FIG. 2 illustrates a general block diagram of the data acquisition circuit block 102 in more detail. In an embodiment, data acquisition block 102 may include various switches 202-208, 210, 214*a*, and 214*b* for directing various currents to LED 114 and Si-diode 104, as will be explained in further detail below. In an embodiment, the switches 202-208, 210, 214*a*, and 214*b* can be implemented using an analog multiplexer circuit, and in general may comprise any suitable circuitry for switching analog signals.

Analog measurements can be collected using a sample and hold circuit 215 and a gain stage 216. A 10-bit analog-to-digital converter (ADC) 218 can convert analog signals produced by the gain stage 216 to a suitable digital format for processing by the temperature processing block 106.

In an embodiment, samples of forward voltage ($V_F$) measurements from LED 114 and from Si-diode 104 can be taken approximately every 2-3 seconds (e.g., every 2.5 seconds) under various driving currents to acquire the following I-V measurement data. The specific timing and sequencing of the measurements in accordance with an embodiment of the present invention are discussed in further detail below:

1. $\Delta V_F$ (PTAT) measurement on LED 114 at LED current $I_{2,LED}/I_{1,LED}$=1 mA/200 μA=5
2. $V_F$ (CTAT) measurement on LED 114 at LED current $I_{F,LED}$=1 mA
3. $\Delta V_F$ (PTAT) measurement on the on-chip Si-diode 104 at Si-diode current $I_{2,Si}/I_{1,Si}$=10 μA/2 μA=5
4. $V_F$ (CTAT) measurement on the Si-diode 104 at Si-diode current $I_{F,Si}$=10 μA As shown in FIG. 2, current sources generating $I_{2,LED}$=1 mA, $I_{2,Si}$=10 μA, $I_{1,LED}$=200 μA, $I_{1,Si}$=2 μA can drive either the LED 114 or the Si-Diode 104, by operation of the switches 202, 204, 206, 208, respectively, to obtain the above four $\Delta V_F$ or $V_F$ measurements corresponding to the LED 114 or Si-diode 104. Current source 212 can be used to drive LED 114 under normal operating conditions, but may be switched off when sampling of the $\Delta V_F$ or $V_F$ measurements on the LED 114 is performed. Switches 214*a*, 214*b* connect the forward voltage $V_F$ of the LED 114 or Si-diode 104 to the sample-and-hold circuit 215, and gain stage 216 amplifies the difference between the forward voltage $V_F$ via switch 214*a* and the ground voltage via switch 214*b* to produce the analog value 217 corresponding to the forward voltage $V_F$ of the measured LED 114 or Si-diode 104. ADC 218 then converts this analog value 217 to a digital value 105 representative of such forward voltage $V_F$ measurement.

In an embodiment, the sampling of the forward voltage $V_F$ is conducted by the data acquisition block 102, the following sampling sequence may be performed:

1. $I_{LED}$ current 212 to the LED 114 is shut off (via PWM control gate (On/Off signal) to the $I_{LED}$ current source 212 in FIG. 2) when the forward voltage of the LED 114 is measured.
2. An appropriate "wait time" (approximately 10 μsec) lapses with the $I_{LED}$ in the "off" state to ensure full "off state" current settling of $I_{LED}$ current.
3. Switch 210 is closed in order to connect one of the forcing current sources $I_{F1}$ or $I_{F2}$ to the LED 114.

Then, one of the four sampling sequences is performed (i.e., LED PTAT Sampling, LED CTAT Sampling, Silicon Diode PTAT Sampling, or Silicon Diode CTAT Sampling). Note that, although data acquisition block 102 as illustrated in FIG.

2 is simplified to measure I-V data from one LED 114, data acquisition block 102 can also be expanded to measure I-V data from additional LEDs, for example, 3 LEDs corresponding to red (R), green (G), and blue (B). Examples can be found in several devices manufactured and sold by the assignee of the present invention, data sheets for which are appended hereto as Appendix A, Appendix B, and Appendix C, all of which are incorporated herein by reference in their entirety for all purposes. For example, Appendix A describes a device whereby temperature compensation is provided in an RGB LED driver. Appendix B describes another version of an LED driver that incorporates an embodiment of the present invention. Appendix C describes an LED temperature and PWM controller that includes an embodiment of the present invention.

LED PTAT Sampling

For PTAT sampling for the LED 114, a current of $I_{F2}$ (e.g., 1 mA in the present embodiment) is forced through the LED 114 by closing switch 202 for approximately 40 μsec. The forward voltage $V_{F2}$ of the LED 114 at current $I_{F2}$ is measured by closing switches 214*a*, 214*b* for an additional time (approximately 5 μsec) to sample & hold the LED forward voltage onto the capacitors C in the sample and hold circuit 215. Then the switches 214*a*, 214*b* are returned to the open state. A pre-scale gain stage 216 ahead of the ADC 218 is included to adjust for the variations in sampled voltages levels of the various measurement types. The amplified, measured LED forward voltage 217 is digitized by ADC 218 to generate digital $V_{F2}$ readings (for the PTAT method) 105. In an embodiment, the ADC 218 may include an additional input sample and hold (S&H) stage (not shown) so that the ADC 218 can digitize the sample 217 while a next sample is being taken. In an embodiment, the ADC 218 can process a sample in approximately 40 μsec. The ADC 218 converts the sampled and amplified voltage 217 to a 10 bit word and may store it in a register (not shown) for "downstream" digital processing in temperature processing block 106 (FIG. 1).

Then, switch 202 is opened and, while keeping the $I_{LED}$ current 212 off, switch 206 is closed to force the second current $I_{F1}$ (e.g., 200 μA in the present embodiment) to the LED 114. Again, after approximately 40 μsec to allow settling of the new forward voltage $V_{F1}$ of LED 114 corresponding to current $I_{F1}$, switches 214*a*, 214*b* are closed to sample and hold the forward voltage $V_{F1}$ for approximately 5 μsec, and then returned to the "open" state. Again the ADC 218 digitizes the forward voltage $V_{F1}$ and may store it in a register (not shown). The two stored voltage samples representing $V_{F2}$ and $V_{F1}$ may be digitally subtracted and stored as the $\Delta V_F$ value corresponding to PTAT method for the LED 114.

$\Delta V_F$ readings for the PTAT method are generally small voltage levels that range from only 20 mV to 100 mV across the full temperature range. Thus, for example, an 8× pre-scale gain setting may be applied in gain stage 216 when $\Delta V_F$ sampling is made for the LED 114 in order to ensure that the analog voltage signals are normalized for the ADC 218 dynamic range of approximately 1.2V. This completes the LED PTAT sampling of the $\Delta V_F$ value for the LED 114.

LED CTAT Sampling

For CTAT sampling on the LED 114, $I_{LED}$ current source 212 is switched off and switch 202 is closed to force the CTAT current $I_{F2}$ (e.g., 1 mA in the present embodiment) to flow in LED 114. After approximately 40 μsec to allow settling of the LED forward voltage, switches 214*a*, 214*b* are closed to sample and hold the CTAT voltage $V_{F2}$ corresponding to the CTAT current $I_{F2}$ for approximately 5 μsec, and then returned to the open state. The pre-scale gain of gain stage 216 is set to 0.25× gain mode for LED $V_F$ sampling as LED forward voltages can be as high as approximately 4 V for white LEDs. Such pre-scale gain ensures that the LED $V_F$ samples are normalized to the dynamic range of ADC 218. ADC 218 digitizes the 217 voltage and stores it in a register for LED CTAT $V_F$ samples for further processing.

At this point, the LED forward voltage sampling of LED 114 is complete so the $I_{LED}$ current source 212 can be returned to the "on" state to allow normal PWM operation, and all the switches 202, 204, 206, 208, 210, 214*a*, 214*b* are set to the "open" state.

Si-Diode PTAT Sampling

Sampling of forward voltage data for the Si-diode 104 may be performed in the same manner as described above for the sampling of forward voltage data for LEDs 114, except that the $I_{LED}$ current source 212 may remain turned on to drive the LED 114 since there is no need to interrupt the PWM operation of the LED 114 when conducting forward voltage sampling on the Si-diode 104.

For PTAT sampling of the Si-diode 104, a current of $I_{F2}$ (e.g., 10 μA in the present embodiment) is forced through the Si-diode 104 by closing switch 204 for approximately 40 μsec. The forward voltage $V_{F2}$ of the Si-diode 104 at current $I_{F2}$ is measured by closing switches 214*a*, 214*b* for an additional time (approximately 5 μsec) to sample & hold the Si-diode forward voltage onto the capacitors C. Then the switches 214*a*, 214*b* are returned to the open state. The measured diode forward voltage 217 as amplified by gain stage 216 is digitized by ADC 218 to generate digital $V_{F2}$ readings 105 for the PTAT method on the Si-diode 104. ADC 218 converts the sampled and amplified voltage 217 to a 10-bit word and stores it in a register (not shown) for "downstream" digital processing in temperature processing block 106 (FIG. 1).

Then, switch 204 is opened and switch 208 is closed to force the second current $I_{F1}$ (e.g., 2 μA in the present embodiment) to the Si-diode 104. Again, after approximately 40 μsec to allow settling of the new forward voltage $V_{F1}$ of the Si-diode 104 for current $I_{F1}$, switches 214*a*, 214*b* are closed to sample and hold the forward voltage $V_{F1}$ for approximately 5 μsec, and then returned to the "open" state. Again, the ADC 218 digitizes the forward voltage $V_{F1}$ and stores it in a register. The two stored voltage samples representing $V_{F2}$ and $V_{F1}$ are digitally subtracted and stored as the $\Delta V_F$ value corresponding to the PTAT method for the Si-diode 104.

Si-Diode CTAT Sampling

For CTAT sampling on the Si-diode 104, switch 204 is closed to force the CTAT current $I_{F2}$ (e.g., 10 μA in the present embodiment) to flow in Si-diode 104. After approximately 40 μsec to allow settling of the Si-diode 104 forward voltage, switches 214*a*, 214*b* are closed to sample and hold the CTAT voltage $V_{F2}$ corresponding to the CTAT current $I_{F2}$ for approximately 5 μsec, and then returned to the open state. The pre-scale gain of gain stage 216 is set to 1.0× gain mode as the Si-diode forward voltages will be approximately 0.6V to 0.8V which is already matched to the ADC 218 dynamic range. ADC 218 digitizes the measured voltage 217 and stores it in a register for Si-diode CTAT $V_F$ samples for further processing.

In Situ Calibration Approach

In an embodiment of the present invention, the integrated LED temperature sense and compensation circuit 100 and LED current driver 110 can be placed proximate to the actual LED 114 (usually within a few inches or less) on a circuit board. Therefore, the Si-diode 104 and the LED 114 essentially experience the same local thermal ambient conditions. Also, at the system start-up or power-on state, no current is yet applied to the LED 114 or the integrated Si-diode 104. Therefore a stable thermal equilibrium point exists where the associated junction temperatures of the LED 114 and the Si-diode 104 can be considered equal (to the accuracy level specified). The temperature sense and compensation circuit 100 may perform a calibration phase during this start-up, or power-on, period so that a reliable absolute starting LED junction temperature can be determined from a PTAT measurement taken for the Si-diode 104. This starting temperature can then be designated as the LED junction starting temperature (T1). In an embodiment, the LED junction starting temperature can be further "weighted" based on system thermal properties.

During the calibration phase, the LED temperature sense and compensation circuit 100 can force two higher "snooping" currents (a few tens of milliamps) with a ratio of approximately 1.1 through the LEDs 114 and measure the corresponding LED forward voltages $V_F$ to calculate the $R_s$ (series resistance) of the LED 114 during in situ operation. The $R_s$ value is stored in on-chip memory (not shown) for further "real time" measurements.

With the LED starting junction temperature point and the stored $R_s$ value, the temperature sense and compensation circuit 100 in the calibration phase can digitally calculate the non-ideality factor $\eta$ of the measured LED 114 by application of a derivative form of the "diode" equation (i.e., Equation 2 above) that solves for $\eta$. The measured and calculated non-ideality factor $\eta$ from the calibration phase is also stored in memory (not shown) to support further "real time" (in situ) PTAT measurements for the LED 114.

The LED CTAT "K" factor (i.e. the change in LED forward voltage, $V_F$, over temperature, at a constant forward bias current, $I_F$) can be loaded into a memory (not shown) from LED vendor supplied specifications, or characterized and stored during system level development. As low level "snooping" currents are applied to prevent the measurement process from inducing additional heating, the "K" factor is derived at the low current level $I_{F2}$ (=1 mA).

In other embodiments, additional control, sensing, and processing circuits may be used to determine the CTAT "K" factors in real time, for example, when multiple LED lamps are available in close proximity to each other together with the LED temperature sense and compensation circuit 100. In such embodiments, one LED is operated at a high current level to "heat up" another LED for which calibration is desired. The LED 114 to be calibrated and the Si-diode 104 can both be operated with zero DC current so that they induce no self-heating and only the heating effects from the "heater" LED device causes a rise to the ambient temperature near all the elements. The ambient temperature is sufficiently measured using the PTAT method and is stored as a second temperature point T2 for the in situ calibration of the CTAT "K" factor, as the start up temperature (T1) has already been determined by the previous calibration phase explained above. The "K" factor can be digitally calculated, after taking a second $V_{F2}$ CTAT sample at a new temperature point, by the following Equation 5:

$$K=(V_{F2}-V_{F1})/(T2-T1) \qquad \text{Equation 5.}$$

PWM Control for Forward Voltage Sampling

Figure 3:
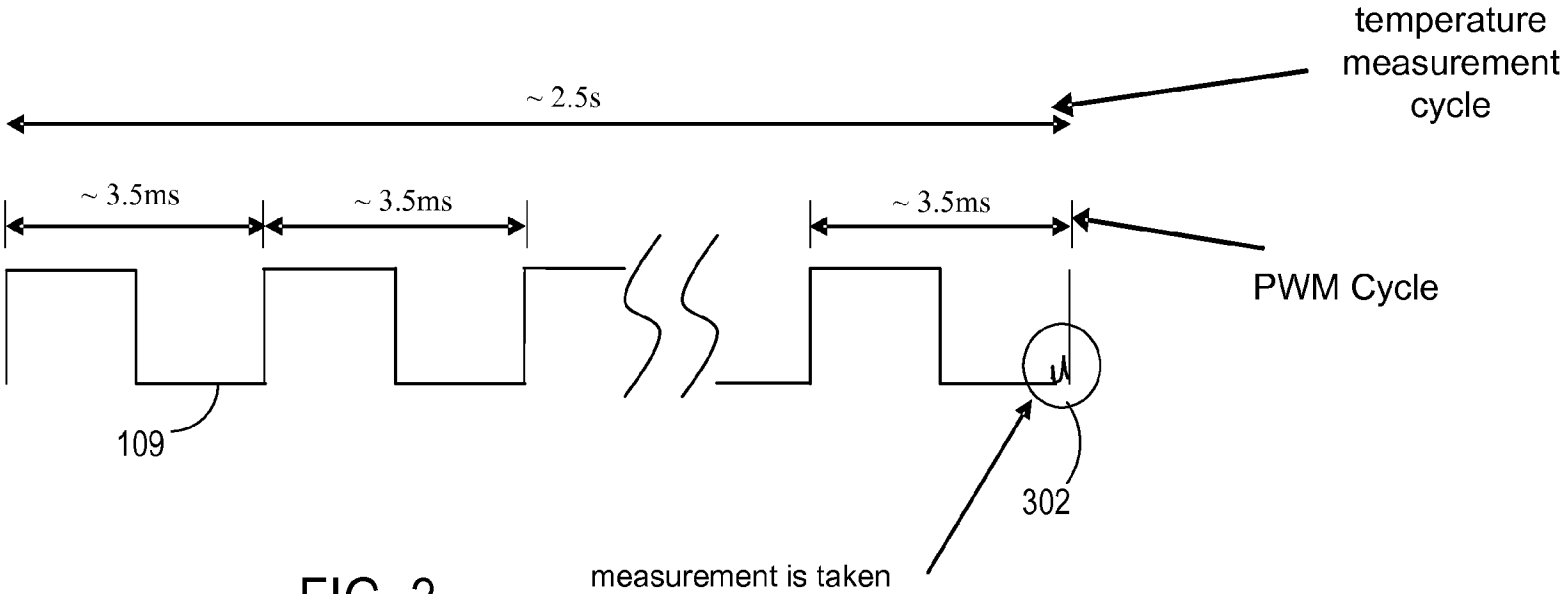
FIG. 3 illustrates how CTAT and PTAT sampling are performed during the PWM cycles of the LED without interrupting the PWM operation of the LED, according to one embodiment.

FIG. 3 illustrates how CTAT and PTAT sampling can be performed during the PWM cycles of the LED without interrupting the PWM operation of the LED, according to embodiments of the present invention. Once the start-up calibration phase is complete, LED temperature sense and compensation circuit 100 may continually sample the forward voltage of LED 114 and the integrated Si-diode 104, as explained above, at a periodic rate of once approximately every 2-3 seconds. The LED current driver 110 is operated in PWM mode where the set DC biased current is modulated as required by PWM to meet the desired brightness or power requirements. The two low level (1 mA and 200 μA) currents for the LED 114 are switched in via switches 202, 206 during a very short period 302 of the "off" time durations of the PWM current control waveform driving the LED 114 to determine the CTAT and PTAT readings of the forward voltage of the LED 114. For this reason, they may be referred to as "snooping" currents. Since these "snooping" currents are low level currents, namely 1 mA and 200 μA, they do not cause self heating of the LED 114 itself and thus do not impact the temperature sensing of the LED 114 in any significant manner.

Accordingly, embodiments of the present invention allow the LEDs 114 to be operated in "real time" at up to 100% PWM current duty cycle and still provide for temperature sensing. As explained above, the LED temperature sense and compensation circuit 100 can disable the normal PWM operation and apply the "snooping" currents (via switches 202, 206) for a very short duration 302 (e.g., on the order of tens of μS) and at a relatively low frequency (once every 2 to 3 seconds), to measure, digitize, and store the forward voltage samples for the CTAT and PTAT readings of the LED 114. The typical PWM current waveform has a frequency in the range of 200 to 350 Hz and will be momentarily disrupted for a maximum of less then 200 μs to apply the two "snooping" currents via switches 202, 206 and measure the associated forward voltages of the LED 114. For example, in the embodiment of FIG. 3, the PWM cycle has a period of approximately 3.5 mS and the LED sampling cycle has a period of approximately 2.5 seconds, resulting in LED forward voltage measurement 302 occurring every 714 cycles of the PWM operation of the LED 114. This small interruption 302 has no visual or other perceived effect to the actual LED PWM operation. The measurement of the forward voltages of the Si-diode 104 is independent of the LED PWM operation and thus does not interrupt the PWM driving current being supplied to the LED 114.

Digital Processing and Temperature Calculation

Figure 4:
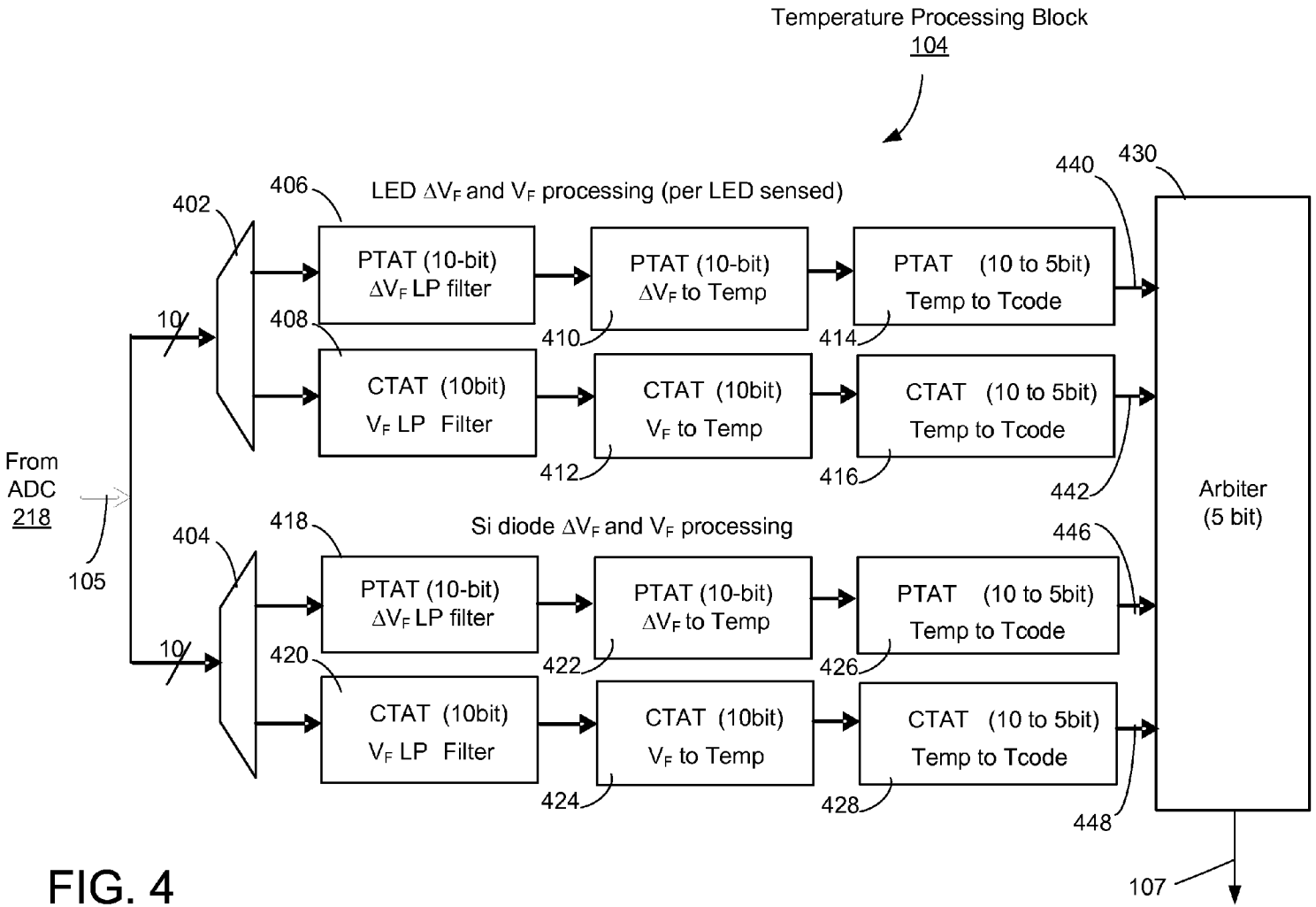
FIG. 4 illustrates the temperature processing block in more detail, according to one embodiment.

FIG. 4 illustrates the temperature processing block 104 in more detail, according to an embodiment. In general, temperature processing block 104 performs digital filtering and processing and diode equation calculations on the four forward voltage samples (LED PTAT data, LED CTAT data, Si-diode PTAT data, and Si-diode CTAT data) obtained by data acquisition block 102 to convert them to "raw" PTAT and CTAT derived "temperature codes." More specifically, multiplexers 402, 404 steer each of the four 10-bit forward voltage samples (LED PTAT data, LED CTAT data, Si-diode PTAT data, and Si-diode CTAT data) obtained from ADC 218 to an appropriate filtering process.

In an embodiment, the $\Delta V_F$ samples from the LED 114 may be filtered by low pass filter 406, converted to a temperature value (Temp) using Equation 4 above in block 410, and then converted to a 5 bit "raw" PTAT temperature code (Tcode) 440 for the LED 114 in block 414. The $V_F$ samples from the LED 114 may be similarly filtered by low pass filter 408, converted to a temperature value (Temp) using Equation 2 above in block 412, and then converted to a 5 bit "raw" CTAT temperature code (Tcode) 442 for the LED 114 in block 416. The $\Delta V_F$ samples from the Si-diode 104 may be filtered by low pass filter 418, converted to a temperature value (Temp) using Equation 4 above in block 422, and then converted to a 5 bit "raw" PTAT temperature code (Tcode) 446 for the Si-diode 114 in block 426. The $V_F$ samples from the Si-diode 104 may be filtered by low pass filter 420, converted to a temperature value (Temp) using Equation 1 above in block 424, and then converted to a 5 bit "raw" CTAT temperature code (Tcode) 448 for the Si-diode 114 in block 428. Note that these functional blocks 406-428 may be implemented using digital logic, a simple microcontroller, or other types of processors to conduct the various calculations involved in the conversions.

In an embodiment, these "raw" temperature codes 440, 442, 446, 448 may be processed by an arbitration algorithm provided arbiter 430 to factor out "outlier" data samples caused by noise or other system measurement issues using median and mean averaging filters to determine the temperature value 107 of the LED 114 to be used by temperature compensation block 108 for PWM operation. As will be explained in more detail below with reference to FIG. 5, arbiter 430 may employ priority encoding techniques and compare the LED temperature measurement estimates with the changes in the Si-diode 104 measurements to further validate the estimation. The result can then be stored as a 5 bit digital temperature code (Tcode) 107 representing the estimated LED junction temperature in the range of −35° C. to 120° C., in 5° C. increments in one embodiment.

Figure 5:
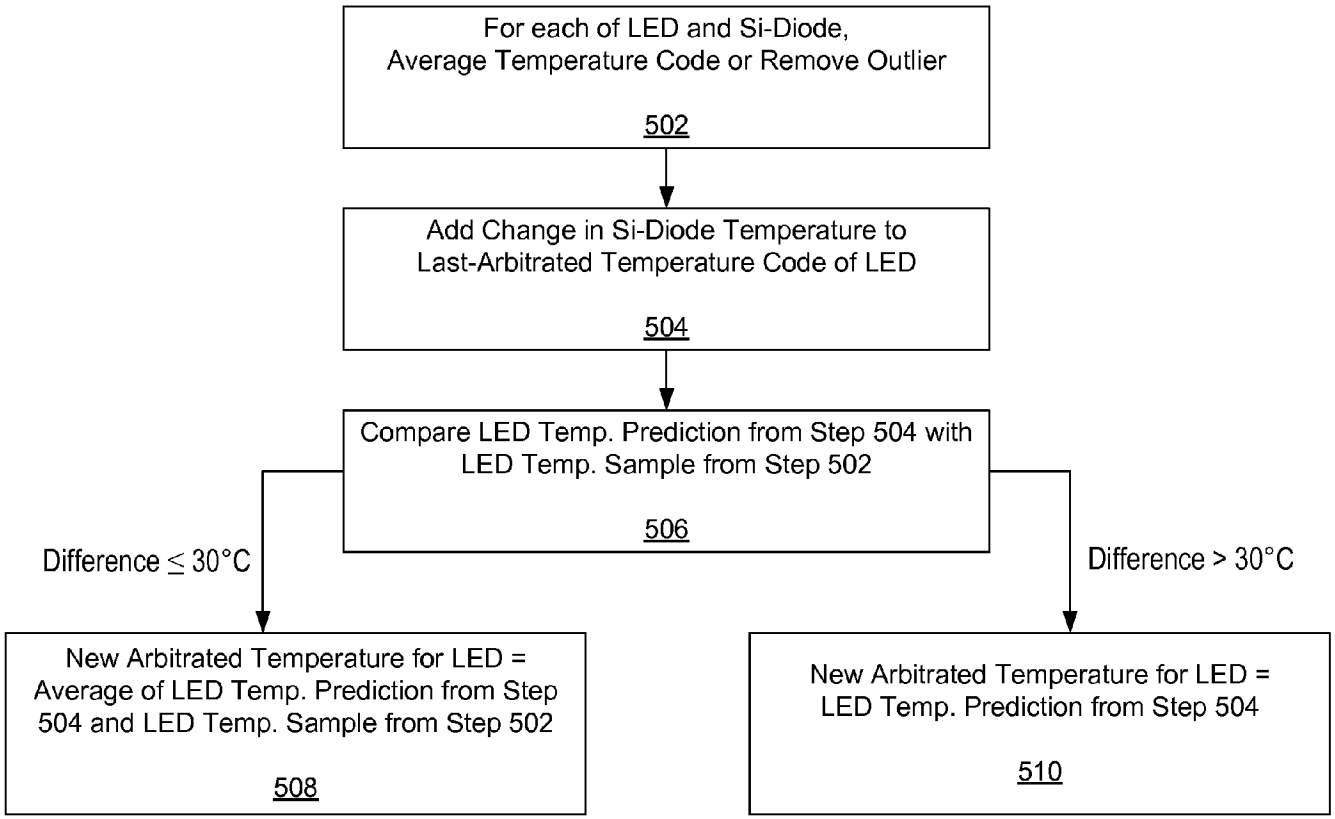
FIG. 5 is a flowchart illustrating the arbitration algorithm used in the arbiter to determine the temperature code representing the estimated LED junction temperature, according to one embodiment.

FIG. 5 is a flowchart illustrating the arbitration algorithm used in the arbiter to determine the temperature code representing the estimated LED junction temperature, according to an embodiment. First, in step 502, the temperature codes are grouped as LED samples 440, 442 and Si-diode 104 samples 446, 448, and a priority is established among the temperature codes 440, 442, 446, 448. If the absolute difference between the temperature group in each sample type is below a predetermined threshold (representing the temperature error spread between the data points), a simple average of the two samples is taken. If the absolute difference is greater than the predetermined error threshold, then a priority is assigned to disregard the potential "outlier" point and pass the prioritized value to the next step 504 in the arbitration.

For example, among the LED temperature codes 440, 442, if the difference between the LED temperature codes 440, 442 is below the predetermined threshold, the average of the temperature codes 440, 442 is passed onto the next step 504 as the LED temperature code. But, if the difference between the LED temperature codes 440, 442 is greater than the predetermined threshold, then the outlier of the two LED temperature codes 440, 442 is removed and the non-outlier temperature code becomes the prioritized value and is passed onto the next step 504 as the LED temperature code. In an embodiment, an outlier temperature code for the LED may be defined as a temperature code that represents an LED temperature that is more than 40 degrees above the ambient temperature.

In an embodiment, the step 502 can be independently performed on the temperature codes 446, 448 corresponding to temperature of the Si-diode 104. An averaged or prioritized temperature code for the Si-diode 104 may then be passed on to the next step 504.

The next step 504 in the arbitration process is to compute and observe the changes in the temperature code of the Si-diode 104 (determined in step 502) from its previously arbitrated temperature code, and to add a difference (plus or minus) between the current and previous temperature codes of the Si-diode 104 to the previously arbitrated temperature code for the LED 114 to obtain a predicted LED temperature code value. As the Si-diode 104 has effectively ideal and known diode properties, weight is given to silicon sample temperature variations.

Since both the LED 114 and the Si-diode 104 are located in close enough proximity, global ambient temperature changes would affect the LEDs 114 and the Si-diode 104 equally. Thus, in step 506, the arbiter 430 compares the predicted LED temperature code value obtained in step 504 with the averaged or prioritized LED temperature code obtained in step 502 to see if they match. If the difference between the predicted LED temperature code (step 504) and the averaged or prioritized LED temperature code (step 502) is not greater than 30 degrees, this may indicate that the new averaged or prioritized LED temperature code sample (step 502) and the predicted LED temperature value based on Si-diode 104 temperature measurements (step 504) are both accurate. Any difference between the two values might be caused by additional LED self-heating effects which would only effect the LED 114 and not be common to the Si-diode 104. Therefore, under this condition, in step 508 the sampled and predicted LED temperature codes obtained from steps 502, 504 are averaged to obtain the a arbitrated temperature code for the LED 114. This method is used because, if diode self-heating is present, then during subsequent sampling of the LED temperature, the averaging in step 508 would cause the arbitrated LED temperature code to converge to the final, accurate LED temperature that reflects both the global ambient temperature change and the LED self-heating temperature change.

In an embodiment, the 30° C. threshold used in the comparison of step 506 is based upon reasonable assumptions of maximum rise in the temperature of the LED junction over the rise in ambient temperature in a properly designed LED thermal system. It is understood of course, that other appropriate thresholds may be used in step 506 to accommodate varying system implementations.

Continuing with FIG. 5, if the difference between predicted LED temperature code (step 504) and the averaged or prioritized LED temperature code (step 502) is greater 30° C., this may indicate that the newly sampled LED temperature code (step 502) is potentially in error and perhaps should be disregarded. Accordingly, in step 510 the predicted LED temperature code determined in step 504 can be used as the newly arbitrated LED temperature code. Either step 508 or step 510 completes the arbitration processing for the current sampling cycle of the temperature of the LED 114 and the Si-diode 104.

PWM Temperature Compensation

Figure 6:
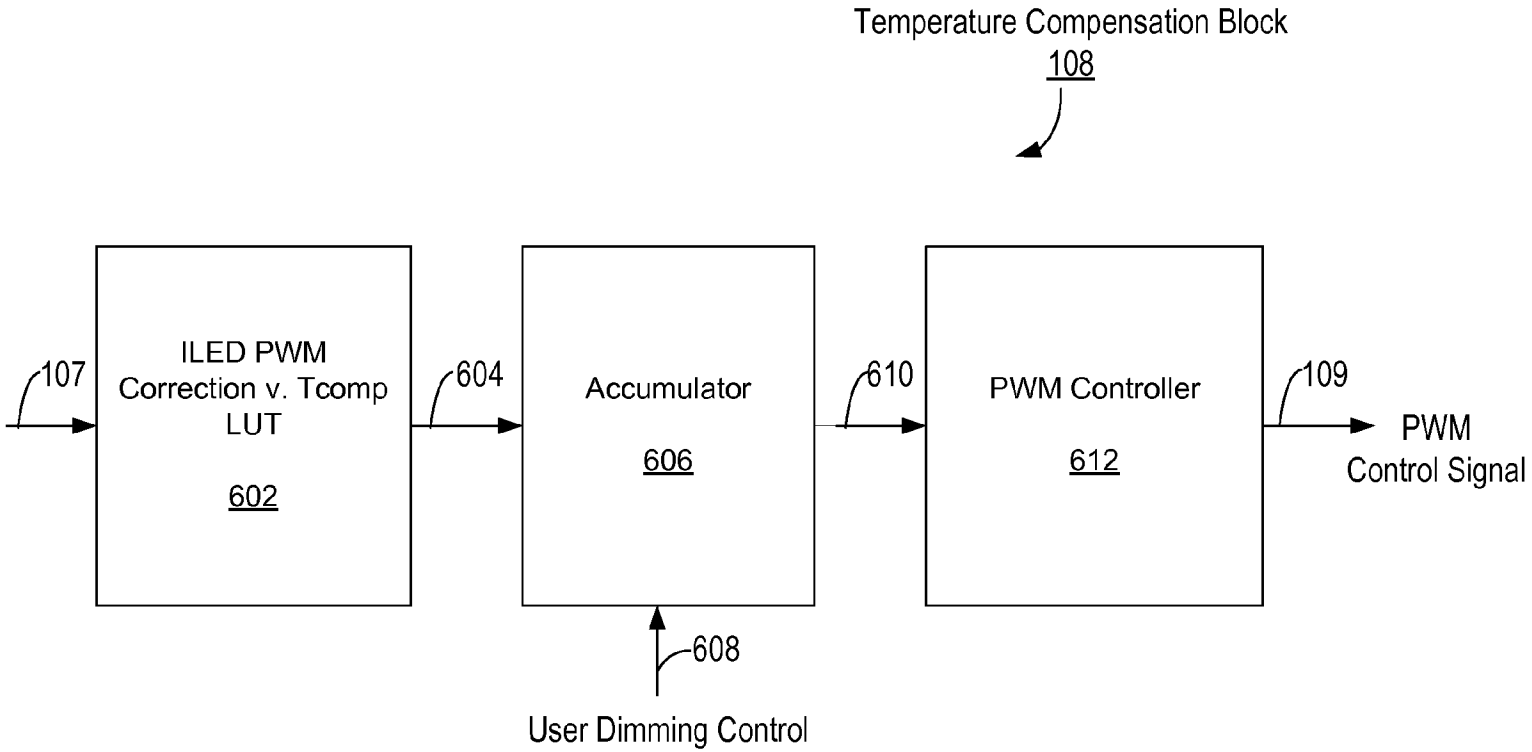
FIG. 6 illustrates the temperature compensation block in more detail, according to one embodiment.

FIG. 6 illustrates the temperature compensation block 108 in more detail, according to an embodiment. Temperature compensation block 108 includes a look-up table (LUT) 602, an accumulator 606, and a PWM controller 612. LUT 602 stores the appropriate correction to be made to the PWM duty cycle of the LED drive current 212 (FIG. 2) corresponding to the determined (arbitrated) temperature code 107 of the LED 114, as obtained by arbiter 430 according to the algorithm of FIG. 5. In an embodiment, the LUT 602 stores only difference (delta) adjustment codes for each 5 degree step and not the absolute $I_{LED}$ current values, in order to significantly reduce on-chip storage requirements, as only 32×4 bit correction codes need to be stored in the LUT 602. Thus, the LUT 602 outputs PWM duty cycle adjustment values (plus or minus) 604 that correspond to the determined LED temperature. Accumulator 606 accumulates and keeps track of the total required PWM adjustments 604 made from the actual user supplied PWM dimming level 608 to generate the final PWM duty cycle level 610 to be used to drive the LED 114. PWM controller 612 receives such PWM duty cycle level 610 value and generates PWM control signal 109 to control LED driver 110, which in turns drives current through LED 114 according to the final PWM duty cycle.

As explained above, the present invention uses the combination of CTAT and PTAT methods both on the LEDs 114 to improve accuracy in LED temperature measurement by having a "check and balance" approach that addresses the pros and cons of each of the CTAT and PTAT methods. In addition, CTAT and PTAT samples from an integrated Si-diode 104 with essentially ideal characteristics are additionally taken into consideration to further complement the "check and balance" samples and processing of the LED temperature measurement. The Si-diode 104 plays a very useful role in the calibration process and is a reliable monitor for global ambient temperature transitions during operation common to both the LED 114 and the Si-diode 104.

Upon reading this disclosure, those of skill in the art will appreciate still additional alternative designs for a method and system for monitoring the temperature of the LED junction in real time. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the present invention.

What is claimed is:

1. An LED (light emitting diode) circuit having temperature compensation, the circuit comprising:

an LED terminal for connection to an LED device that is separate from the LED circuit;

an LED driver configured to output an LED drive signal to operate the LED device to produce light;

a first current source selectively connectable to the LED terminal and configured to output a first snoop current;

a second current source selectively connectable to the LED terminal and configured to output a second snoop current;

an amplification circuit configured to measure a forward voltage of the LED device when the LED device is driven by either the first snoop current or the second snoop current; and a temperature compensation circuit configured to receive a first measured forward voltage when the LED device is driven by the first snoop current and to receive a second measured forward voltage when the LED device is driven by the second snoop current, the temperature compensation circuit further configured to output an adjustment signal that is based at least on the first and second measured forward voltages, wherein the LED driver varies the LED drive signal depending on the adjustment signal.

2. The circuit of claim 1 wherein the first snoop current and the second snoop current are applied to the LED terminal during operation of the LED device by the LED drive signal.

3. The circuit of claim 1 wherein the LED driver creates a plurality of OFF periods in the LED drive signal during operation of the LED device, wherein the first snoop current and the second snoop current are applied to the LED terminal only during some of the OFF periods in the LED drive signal.

4. The circuit of claim 1 wherein a first temperature measurement is determined based on the first and second measured forward voltages, wherein a second temperature measurement is determined based on either the first or the second measured forward voltage and a predetermined constant factor, wherein the adjustment signal is based at least on the first and second temperature measurements.

5. The circuit of claim 4 wherein when power is applied to the LED circuit, a first startup forward voltage of the LED device is measured and a second startup forward voltage of the LED device is measured, wherein a startup temperature is determined based on the first and second startup forward voltages, wherein a subsequent forward voltage of the LED device is measured at a time subsequent to power being applied to the LED circuit, wherein the predetermined constant factor is based at least on the startup temperature and the subsequent forward voltage of the LED device.

6. The circuit of claim 1 wherein the LED drive signal, the first snoop current, and second snoop current are selectively connectable to the LED terminal.

7. The circuit of claim 1 wherein the LED drive signal is a PWM (pulse width modulated) signal, wherein the LED driver adjusts a duty cycle of the PWM signal based on the adjustment signal.

8. The circuit of claim 1 further comprising a P-N junction device and at least a third current source to drive the P-N junction device, wherein the temperature compensation circuit is further configured to receive a third measured forward voltage when the P-N junction device is driven with a current from the third current source, wherein the adjustment signal is further based on the third measured forward voltage in addition to the first and second measured forward voltages.

9. The circuit of claim 1 wherein when the LED drive signal is an electrical current sufficient to produce visible light from the LED and when the LED drive signal is connected to the LED device.

10. The circuit of claim 1 wherein the first snoop current and the second snoop current, each is insufficient to produce any visible effect from the LED device.

11. A method of determining temperature of an LED device during operation of the LED device, comprising:

generating an LED drive signal;

operating the LED device using the LED drive signal, thereby causing the LED device to emit light; and measuring a temperature of the LED device during operation thereof, comprising:

generating an OFF period in the LED drive signal; and during the OFF period, applying at least a first forcing current to the LED device and obtaining a first voltage measurement of the LED device while driving the LED device with the first forcing current, wherein a temperature of the LED device is determined based at least on the first voltage measurement.

12. The method of claim 11 wherein the first forcing current is of insufficient magnitude to cause the LED device to produce visible light.

13. The method of claim 11 further comprising, during the OFF period in the LED drive signal, applying at least a second forcing current to the LED device and obtaining a second voltage measurement of the LED device while driving the LED device with the second forcing current, wherein the temperature of the LED device is further based at least on the second voltage measurement.

14. The method of claim 13 further comprising making a first temperature determination based on the first and second voltage measurements, making a second temperature determination based on a predetermined constant and either the first or the second voltage measurement, wherein the temperature of the LED device is further based at least on the first and second temperature determinations.

15. The method of claim 11 further comprising varying the LED drive signal based on the temperature of the LED device.

16. The method of claim 15 wherein the LED drive signal is a PWM signal and a duty cycle thereof is varied based on the temperature of the LED device.

17. The method of claim 11 further comprising generating a plurality of additional OFF periods in the LED drive current, and during some of the additional OFF periods applying at least the first forcing current to the LED device and obtaining additional first voltage measurements of the LED device, wherein additional determinations of the temperature of the LED device are made.

18. The method of claim 17 further comprising, for each additional determination of the temperature of the LED device, varying the LED drive signal based on the each additional determination of the temperature of the LED device.

19. The method of claim 11 wherein the LED drive signal is a PWM signal having a 100% duty cycle.

20. The method of claim 11 wherein operating the LED device includes applying the LED drive signal to the LED device.

21. A method of operating an LED device based on a temperature thereof, comprising:

generating an LED drive signal for operating the LED device, the LED drive signal including at least one OFF period;

during the OFF period in the LED drive signal while operating the LED device:

applying a first snoop current to the LED device;

measuring a first forward voltage of the LED device;

applying a second snoop current to the LED device; and measuring a second forward voltage of the LED device;

determining a first temperature of the LED device based on the first and second forward voltages;

determining a second temperature of the LED device based on a predetermined constant and either the first or the second forward voltage; and determining an arbitrated temperature of the LED device based at least on the first and second temperatures, wherein the LED drive signal is varied based on the arbitrated temperature.

22. The method of claim 21 further comprising:

applying a third snoop current and a fourth snoop current to a P-N junction device independently of the timing of the LED drive signal, and measuring respective third and fourth forward voltages of the P-N junction device;

determining a third temperature of the P-N junction device based on the third and fourth forward voltages; and determining a fourth temperature of the P-N junction device based on the predetermined constant and either the third or the fourth forward voltage, wherein determining the arbitrated temperature is further based on the third and fourth temperatures.

* * * * *